US012025336B1

(12) United States Patent
Galvin et al.

(10) Patent No.: US 12,025,336 B1
(45) Date of Patent: Jul. 2, 2024

(54) DUAL PRESSURE DAMPER

(71) Applicants: Patrick N Galvin, Evergreen, CO (US); Joshua James Gladfelter, Arvada, CO (US); Jacob Alan Suter, Englewood, CO (US)

(72) Inventors: Patrick N Galvin, Evergreen, CO (US); Joshua James Gladfelter, Arvada, CO (US); Jacob Alan Suter, Englewood, CO (US)

( * ) Notice: Subject to any disclaimer, the term of this patent is extended or adjusted under 35 U.S.C. 154(b) by 161 days.

(21) Appl. No.: 17/180,122

(22) Filed: Feb. 19, 2021

Related U.S. Application Data

(60) Provisional application No. 62/978,955, filed on Feb. 20, 2020.

(51) Int. Cl.
*F24F 13/14* (2006.01)

(52) U.S. Cl.
CPC ..... *F24F 13/1413* (2013.01); *F24F 13/1426* (2013.01); *F24F 2013/146* (2013.01)

(58) Field of Classification Search
CPC .. F24F 2013/146; F24F 13/1413; F24F 11/77; F24F 2011/0005; F24F 13/1426
See application file for complete search history.

(56) References Cited

U.S. PATENT DOCUMENTS 6,038,737 A * 3/2000 Boright ..... E05F 1/002 16/292
10,232,286 B1 * 3/2019 Havelick ..... E04H 5/02
2006/0105696 A1 * 5/2006 Wenger ..... F24F 7/013 454/254
2013/0072741 A1 * 3/2013 Tsia ..... G21F 9/001 588/16
2018/0038605 A1 * 2/2018 Lieberman ..... B08B 15/02

FOREIGN PATENT DOCUMENTS

DE 102012205984 A1 * 10/2013 ..... F16K 15/038

OTHER PUBLICATIONS

English translation of DE-102012205984-A1, dated Jan. 17, 2023 (Year: 2023).*

* cited by examiner

*Primary Examiner* — Edelmira Bosques
*Assistant Examiner* — Brett Peterson Mallon
(74) *Attorney, Agent, or Firm* — Edwin H. Crabtree; Ramon L. Pizarro

(57) ABSTRACT

A dual pressure damper used as an air intake damper in an air intake duct, The intake duct is used for introducing intake air into a room. The dual pressure damper helps maintain a negative air pressure "N" in the room. In particular, the room is used for plant oil extraction. The intake air vents toxic gases from the room and out an exhaust duct. The dual pressure damper includes a low pressure damper blade and a high pressure damper blade. A torsion coil spring includes a long torque arm attached to the low pressure damper blade and a short torque arm attached to the high pressure damper blade. The torque arms are used to open and close the damper blades at different incoming air pressures.

12 Claims, 5 Drawing Sheets

DUAL PRESSURE DAMPER

BACKGROUND OF THE INVENTION

(a) Field of the Invention

This invention relates to a dual pressure damper having two damper blades with different opening pressure thresholds, and more particularly, but not by way of limitation, to a dual pressure damper used with an air intake fan for venting toxic gases in an oil extraction room or oil extraction booth and maintaining a negative air pressure "N" in the room. Also, the subject invention can be used for maintaining a positive air pressure "P" in a room.

(b) Discussion of Prior Art

Heretofore, in a laboratory having an inside oil extraction room, air flow is run in a negative ambient pressure "N". The negative pressure "N" can be accomplished by running a ceiling exhaust fan, for example, at 1000 rpm and a ceiling intake fan at 800 rpm. A gas sensor is used to detect hazardous gasses from the oil extraction process. If a hazardous gas does leak during the operation, then the gas escapes out an exhaust duct and not from the oil extraction room into the surrounding area in a laboratory.

Similarly, a positive air pressure "P" in a room can be represented by a computer chip assembly room where HEPA filtered air is introduced into the room under a higher pressure than the ambient pressure in a surrounding facility. This feature ensures that the air in a positive pressure enclosure remains pure, filtered, and dust free. For the purposes of this patent application, reference to negative pressure "N" can also be attributed to positive pressure applications.

During a shutdown of the laboratory and oil extraction room, an air exhaust fan and an air intake fan are not operational. Therefore, there is no airflow through the room. But, a control system continues to monitor hazardous gas levels by reading values on a gas detector. If the control system senses a hazardous or toxic leak during the shut down, the intake fan and the exhaust fan instantaneously increase airflow from stop to full speed. During the increase in airflow, an exhaust air damper in an exhaust duct is pushed open from a positive pressure generated by the exhaust fan. Also at this time, a negative pressure is created by the intake fan, which forces an intake damper open in an intake duct. The intake fan and the exhaust fan are connected to the same building power supply and ramp up to full speed at the same rate. Another instance of instantaneous airflow is when an operator of the oil extraction room hits an emergency button during a shutdown.

Therefore during startup of the fans, the interior of the room may cause a risk to an operator, when instantaneous airflow creates a positive pressure "P" when the intake fan temporarily overpowers the exhaust fan, thus allowing hazardous or toxic gases to escape through openings in the room, such as doors, windows, utility holes, and gaps in wall panels and into the laboratory.

The subject invention includes a dual pressure damper, with an air intake fan, connected to a control system in the oil extraction room. The dual pressure damper is designed to prevent the positive pressure "P" in the room during startup of the intake fan and the exhaust fan.

SUMMARY OF THE INVENTION

In view of the foregoing, it is a primary object of the subject invention to provide a dual pressure damper, used with an air intake fan. The damper having a low pressure damper blade that opens at a lower air pressure, when compared to a high pressure damper blade to help maintain a negative air pressure "N" in the oil extraction room.

Another object of the invention is to provide the dual pressure damper with field changeable torsion coil springs to vary an opening pressure of a low pressure damper blade and a high pressure damper blade.

Yet another object of the invention is to reduce a risk to an operator in the oil extraction room or the laboratory from being exposed to toxic gas when instantaneous airflow, during a startup, creates a positive pressure "P", when the intake fan temporarily overpowers the exhaust fan, thus allowing the toxic gas to escape from the oil extraction room through room openings and into the surrounding laboratory.

These and other objects of the present invention will become apparent to those familiar with plant oil extraction rooms when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes devised for a practical application of the subject dual pressure damper, and in which.

DESCRIPTION OF THE PREFERRED EMBODIMENTS

Figure 1:
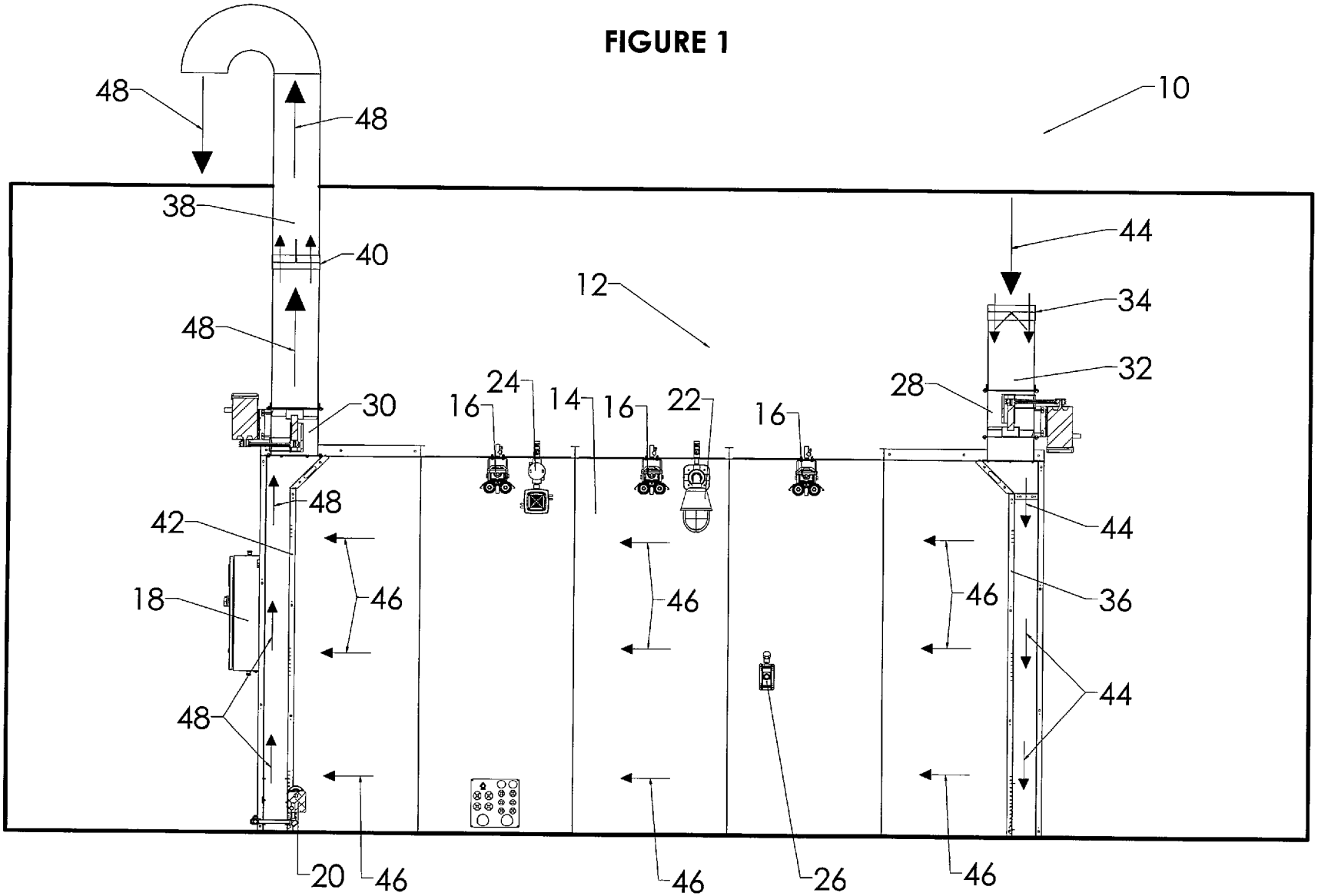
FIG. 1 illustrates a negative pressure plant oil extraction room inside a laboratory.

In FIG. 1, a plant oil extraction facility 10 is shown with a laboratory 12. Inside the laboratory 12 is an oil extraction room 14 or oil extraction booth. The area in the laboratory 12 relies on the room 14 to contain the hazardous and toxic gases generated from a plant oil extraction process.

The plant oil extraction room 14 consists of room lights 16 and a control system 18 that communicates with a gas detector 20. The gas detector 20 is used to sense hazardous or toxic vapor concentrations exceeding levels safe to humans. If the gas detector 20 senses hazardous gas levels considered to be unsafe, a visual alarm 22 and an audible alarm 24 are activated. The alarms notify an operator the room is unsafe. Also, the alarms 22 and 24 can be manually activated by the operator using an emergency button 26. In both cases, the controls system 18 sends power to an intake fan 28 and an exhaust fan 30 to increase the airflow through the room 14 to purge contaminated air with hazardous toxic gases. The subject dual pressure damper is used with the intake fan 28.

The airflow system's intake system consists of an intake duct 32, a spring-loaded, back draft, intake damper 34, the intake fan 28, and an intake plenum 36. The intake plenum is designed to disperse intake air evenly through a cross section of the room 14.

The airflow system's exhaust system consists of an exhaust duct 38, an exhaust damper 40, the exhaust fan 30, and an exhaust plenum 42. The exhaust plenum 42 is designed to concentrate a pull of airflow to specific regions of the plenum so there is laminar flow through the room 14. The intake damper 34 and the exhaust damper 40 are fully closed during a shutdown to prevent outside air from the entering the oil extraction room 14. This feature saves heating and air conditioning expense, when the room's control system 18 is not in operation.

It should be noted in this drawing, incoming fresh air, as indicate by arrows 44, is drawn, using the intake fan 28, from outside the facility 10, into the intake plenum 36. The fresh air 44 is then introduced into the oil extraction room 14. At this time, the air, as indicated by arrows 46, can be contaminated from toxic gases from the oil extraction process in the room and before the contaminated air 46 is drawn into the exhaust plenum 42, using the exhaust fan 30. Exhaust air, as indicated by arrows 48, then exits the facility 10.

Figure 2:
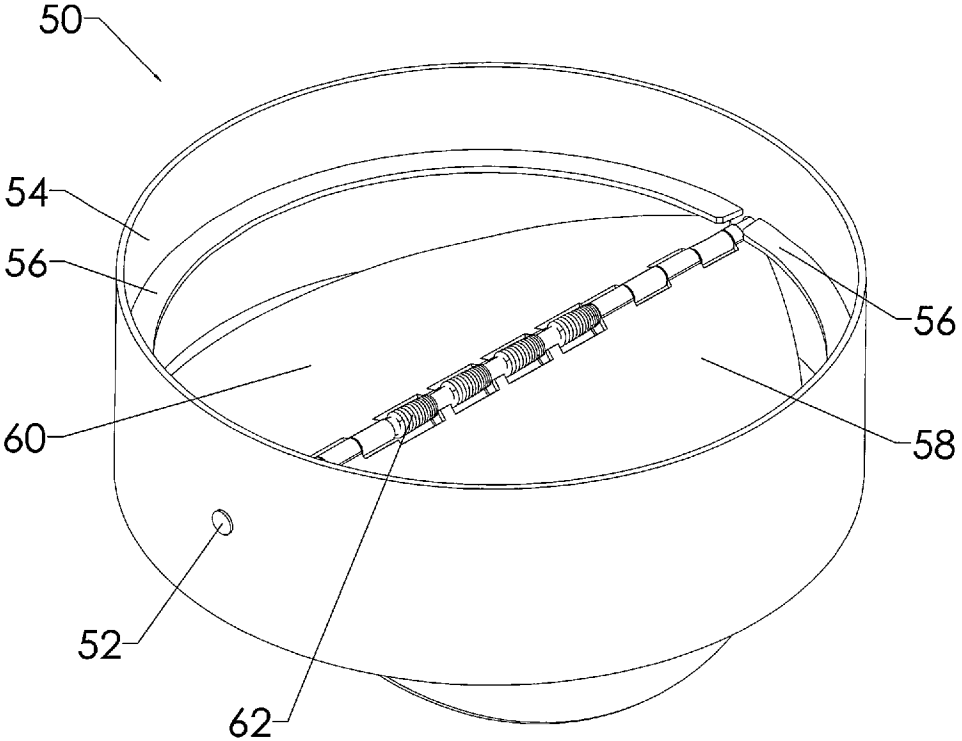
FIG. 2 is a perspective view of the subject dual pressure damper.

In FIG. 2, a dual pressure damper is illustrated having general reference numeral 50. The damper 50 includes a pivot rod 52. Opposite ends of the rod 52 are attached to a duct collar 54. The collar 54 includes a damper blade back stop 56. The back stop 56 creates a blockage for a low pressure damper blade 58 and a high pressure damper blade 60. The blades 58 and 60 prevent outside air from entering the room 14 during shutdown. The pivot rod 52 is removable for installing different sizes of torsion coil springs 62. The springs 62 are non-traditional torsion coil springs with various lengths of torque arms 64 and 66, shown in FIG. 3.

Figure 3:
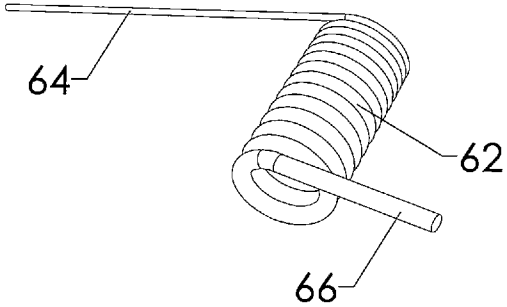
FIG. 3 is a perspective view of a torsion coil spring with varying lengths of torsion arms.

In FIG. 3, one of the coil springs 62 is shown with a short, or high torque, arm 66 for resisting an opening of high pressure damper blade 60. Also, the coil spring includes a long, or low torque, arm 64 for resisting the opening of low pressure damper blade 58. A low pressure, such as 16 psi, can be set for the low pressure damper blade 58. A high pressure, such as 18 psi, can be set for the high pressure damper blade 60.

Figure 4:
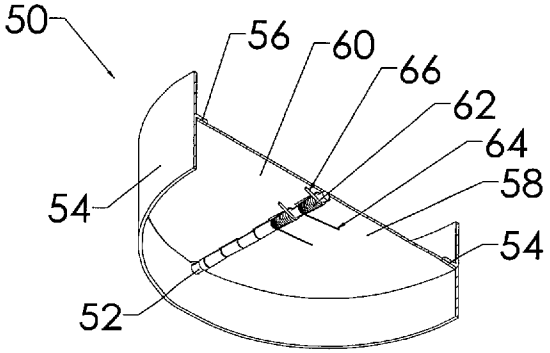
FIG. 4 is a sectional view of the dual pressure damper in a closed position.

In FIG. 4, a sectional view of the dual pressure damper 50 is shown with the low pressure damper blade 58 and the high pressure damper blade 60 holding the blades in a closed position against the back stop 56. In the drawing, the torsion coil springs 62 includes a low torque arm 64 engaging the low pressure damper blade 58 and a high torque arm 66 for engaging the high pressure damper blade 60.

Figure 5:
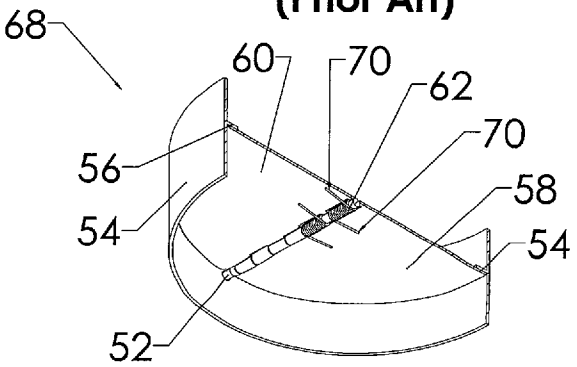
FIGURE 5 (Prior Art)
FIG. 5 is a sectional view of a prior art damper in a closed position.

In FIG. 5, a sectional view of a prior art dual pressure damper is shown having general reference numeral 68. The damper 68 also includes a pivot rod 52, a duct a collar 54, a back stop 56, a low pressure damper blade 58 and a high pressure damper blade 60. But, the prior art damper 68 has coil torsion coil springs 62 having equal length torque arms 70.

Figure 6:
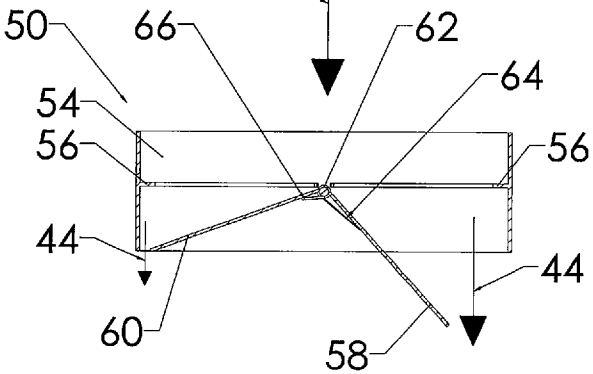
FIG. 6 is a sectional view of the dual pressure damper during a start up of the intake fan.

In FIG. 6, a sectional view of the dual pressure damper 50 is shown with the torsion coil springs holding the low pressure damper blade 58 and the high pressure damper blade 60 in a partially open position. In the drawing, the torsion coil springs 62, with the low torque arm 64, allows the low pressure damper blade 58 to open in a range of 45 degrees. In turn, the torsion coil springs 62, with the high torque arm 66, allows the high pressure damper blade 60 to open in a range of 30 degrees.

Figure 7:
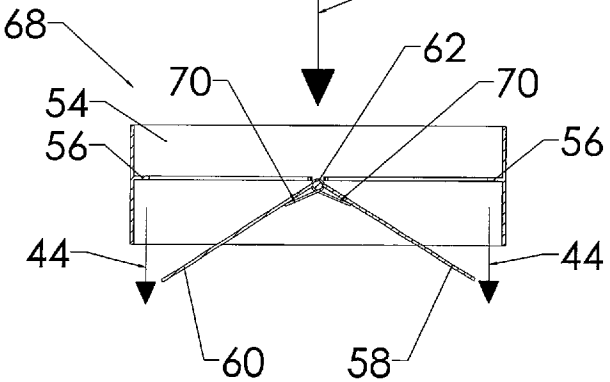
FIGURE 7 (Prior Art)
FIG. 7 is a sectional view of the prior art damper during a start up of the intake fan.

In FIG. 7, a sectional view of the prior art dual pressure damper 68 is shown with the torsion coil springs 62 holding the low pressure damper blade 58 and the high pressure damper blade 60 in a partially open position. In the drawing, the torsion coil springs 62, with equal length torque arms 70, hold both the low pressure damper blade 58 and the high pressure damper blade 60 open in a range of 30 degrees.

Figure 8:
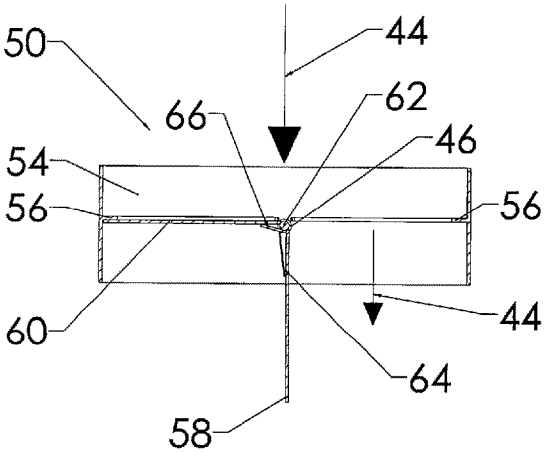
FIG. 8 is a sectional view of the dual pressure damper when the intake fan is at half speed.

In FIG. 8, a sectional view of the dual pressure damper 50 is shown with the torsion coil springs holding the low pressure damper blade 58 held in a completely open position. At this time, the high pressure damper blade 60 is held in a closed position. Due to an increased resistance on the long torque arm 64 of the torsion coil spring 62, the low pressure damper blade 58 is opened and the high pressure damper blade 60 is pushed against the back stop 56.

Figure 9:
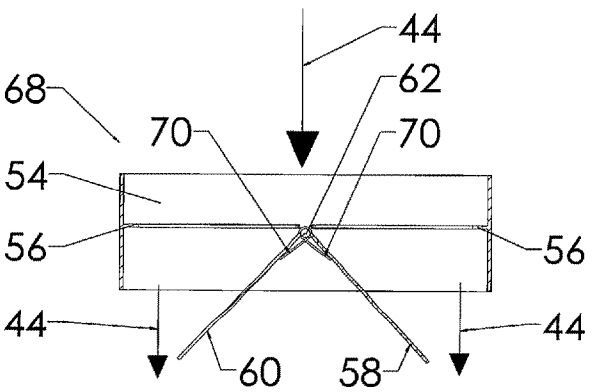
FIGURE 9 (Prior Art)
FIG. 9 is a sectional view of the prior art damper when the intake fan is at half speed.

In FIG. 9, another sectional view of the prior art dual pressure damper 68 is shown and with the air flow 44 increased. In this example, the torsion coil springs 62, with equal length torque arms 70, hold both the low pressure damper blade 58 and the high pressure damper blade 60 open in a range of 45 degrees.

Figure 10:
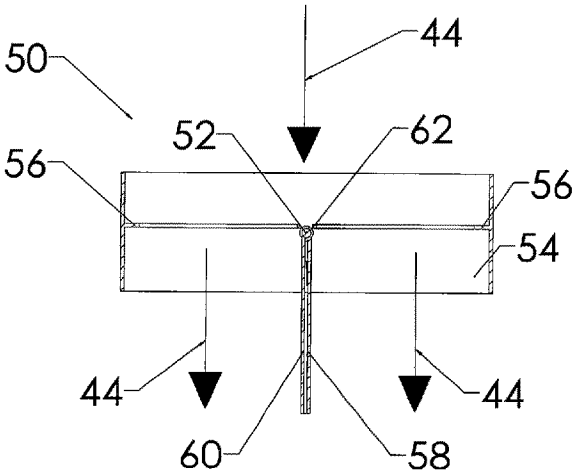
FIG. 10 is a sectional view of the dual pressure damper when the intake fan is at full speed.

In FIG. 10, a sectional view of the dual pressure damper 50 is shown with the torsion coil springs holding the low pressure damper blade 58 held in a completely open position. Also, the high pressure damper blade 60 is held in a completely open position.

Figure 11:
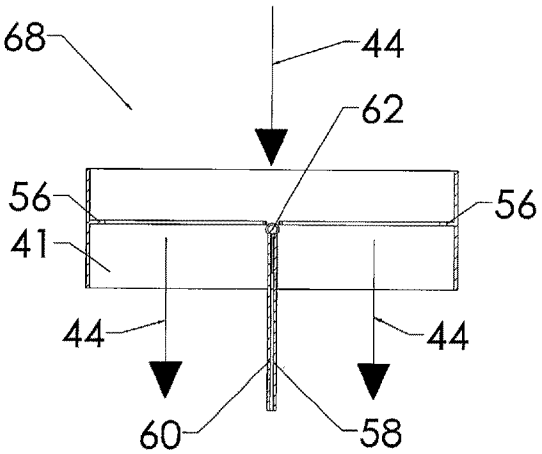
FIGURE 11 (Prior Art)
FIG. 11 is a sectional view of the prior art damper when the intake fan is at fill speed.

In FIG. 11, another sectional view of the prior art dual pressure damper 68 is shown and with the air flow 44 increased. In this example, the torsion coil springs 62, with equal length torque arms 70, hold both the low pressure damper blade 58 and the high pressure damper blade 60 in a completely open position.

Figure 12:
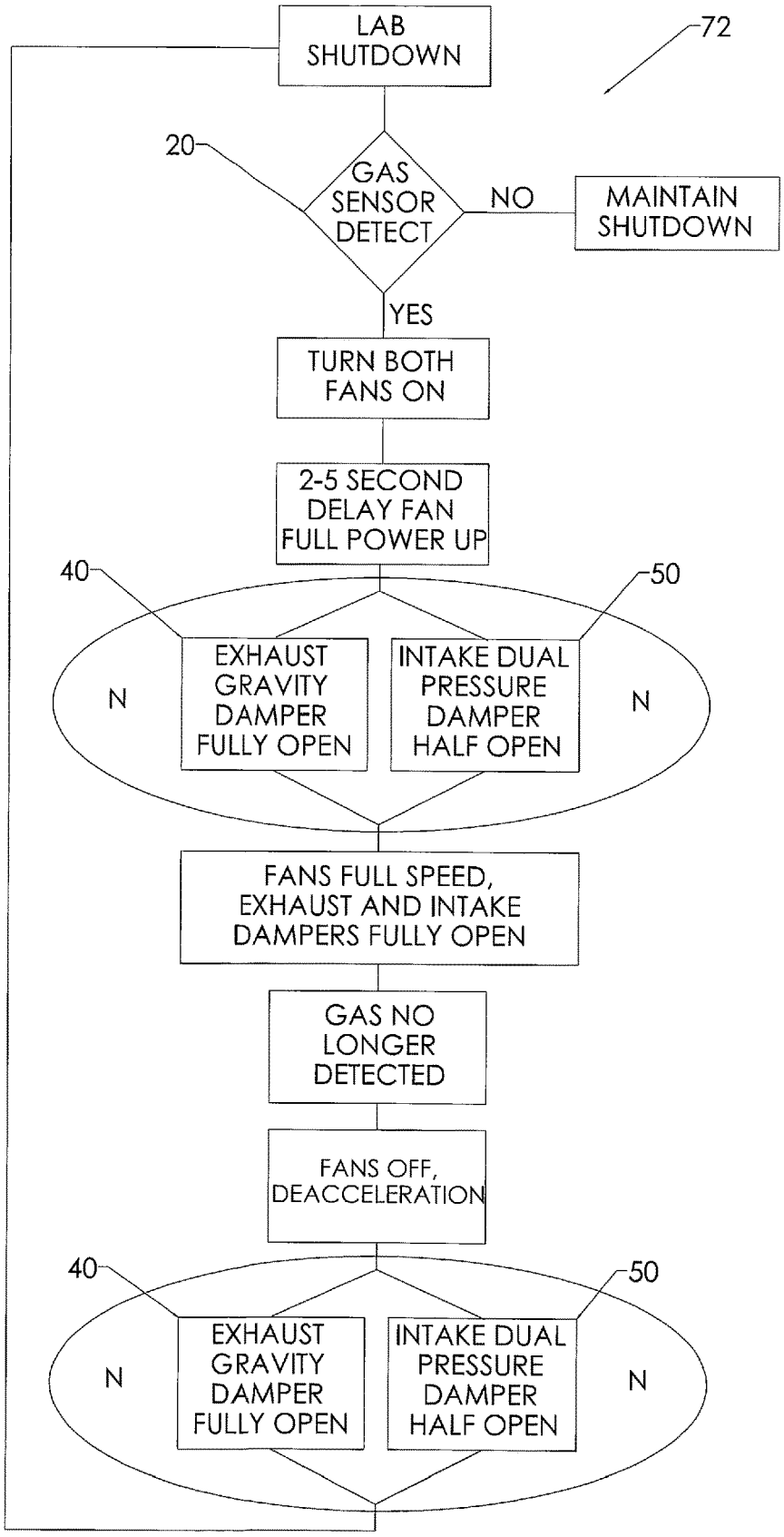
FIG. 12 is a control logic flow chart.

In FIG. 12, a control logic flow chart is shown and having general reference numeral 72. The chart 72 illustrate a sequence of events from the controls system 18, when the gas detector 20 senses hazardous gas during the shutdown of the laboratory 10 and oil extraction room 14. As mentioned above and at this time, the intake fan 28 and the exhaust fan 30 are turned off to save building heating and air conditioning expense. The exhaust damper 40 and the intake damper 34, using the dual pressure damper 50, are fully closed to prevent outside air from entering the facility 10.

Hazardous solvents used in the plant oil extraction process can still be present in vessels contained within the extraction room 14. Also during a shutdown, the gas detector 20 continues to monitor the extraction room 14 for leaks of the hazardous gas. If the gas detector 20 senses hazardous gas, the controls system 18 instantaneously turns on both air intake fan 28 and the exhaust air fan 30 to purge the extraction room of the hazardous gas.

When the two fans are turned on to purge the extraction room 14, there is a 2 to 5 second delay until both fans are at full speed. To ensure the hazardous gas will not escape from the extraction room 14 and into the laboratory 12, while the fans are ramping to full speed, the exhaust damper 40 has little resistance and will open instantaneously to an open position. The dual pressure damper 50, has variable torsion coil springs 62 that require more force to open a high pressure damper blade 60 resulting in a half open damper blade configuration. The difference in the fully exhaust damper 40 and half open dual pressure damper 50 ensures that a negative pressure "N" is achieved in the extraction room 14, while the fans ramp up to full speed.

When the gas detector 20 no longer senses hazardous gases, the power to the fans is turned off. The air continues to move through the air exhaust duct 38, and a net negative pressure "N" is maintained. As the fans decelerate, the exhaust damper 50 is fully open. At this time, the variable torsion coil springs 62 on the dual pressure damper 50 result in a closing of the high pressure damper blade 60 to decelerate the intake fan 28 quicker than the exhaust fan 30 to maintain the net negative pressure "N" in the extraction room 14.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. A dual pressure damper used as an air intake damper in an air intake duct, the intake duct and an intake fan are used for introducing intake air into a room, the dual pressure damper helps maintain a negative air pressure in the room, the dual pressure damper comprising:

a low pressure damper blade rotatably mounted in an intake duct collar;

a high pressure damper blade rotatably mounted in the intake duct collar; and a torsion coil spring having a long torque arm, the long torque arm attached to the low pressure damper blade, the torsion coil spring having a short torque arm attached to the high pressure damper blade, the torque arms used to open and close the damper blades at different incoming air pressures.

2. The dual pressure damper as described in claim 1 further including a pivot rod, opposite ends of the rod are attached to the intake duct collar, the coil spring mounted on the pivot rod.

3. The dual pressure damper as described in claim 2 wherein the pivot rod is removable for attaching various sizes of torsion coil springs thereon.

4. He dual pressure damper as described in claim 1 further including a damper blade back stop disposed around an inner circumference of the duct collar, the damper blades engaging the damper blade back stop when the dual pressure damper is in a closed position.

5. A dual pressure damper used as an air intake damper in an air intake duct, the intake duct and an intake fan are used for introducing intake air into an oil extraction room having an exhaust fan, the dual pressure damper helps maintain a negative air pressure in the oil extraction room, the dual pressure damper comprising:

a low pressure damper blade rotatably mounted in an intake duct collar;

a high pressure damper blade rotatably mounted in the intake duct collar; and a torsion coil spring having a long torque arm, the long torque arm attached to the low pressure damper blade, the torsion coil spring having a short torque arm attached to the high pressure damper blade, the torque arms used to open and close the damper blades at different incoming air pressures.

6. The dual pressure damper as described in claim 5 further including a pivot rod, opposite ends of the rod are attached to the intake duct collar, the coil spring mounted on the pivot rod.

7. The dual pressure damper as described in claim 6 wherein the pivot rod is removable for attaching various sizes of torsion coil springs thereon.

8. The dual pressure damper as described in claim 5 further including a damper blade back stop disposed around an inner circumference of the inlet duct collar, the damper blades engaging the damper blade back stop when the dual pressure damper is in a closed position.

9. An oil extraction room disposed inside a laboratory, the oil extraction room comprising:

an air intake fan for introducing intake air into the oil extraction room;

an air intake duct with a duct collar, the air intake fan mounted inside the duct collar;

a dual pressure damper mounted inside the duct collar: the air intake fan, the air intake duct and the dual pressure damper used for introducing intake air into the room at a certain air pressure, the dual pressure damper including a low pressure damper blade rotatably mounted in the duct collar and a high pressure damper blade rotatably mounted in the duct collar;

an exhaust fan mounted inside an air exhaust duct, the exhaust fan for discharging exhaust air with hazardous gases from the room, the exhaust fan exhausting operating at a certain air pressure greater than air intake pressure, thereby providing a negative air pressure in the oil extraction room; and a torsion coil spring having a long torque arm, the long torque arm attached to the low pressure damper blade, the torsion coil spring having a short torque arm attached to the high pressure damper blade, the torque arms used to open and close the damper blades at different incoming air pressures.

10. The oil extraction room as described in claim 9 wherein the dual pressure damper further includes a damper blade back stop disposed around an inner circumference of the duct collar, the damper blades engaging the damper blade back stop when the dual pressure damper is in a closed position.

11. The oil extraction room as described in claim 9 wherein the dual pressure damper further includes a pivot rod, opposite ends of the rod are attached to the duct collar, the coil spring mounted on the pivot rod.

12. The oil extraction room as described in claim 11 wherein the pivot rod is removable for attaching various sizes of torsion coil springs thereon.

* * * * *